United States Patent [19]

Brush, Sr. et al.

[11] Patent Number: 4,461,530

[45] Date of Patent: Jul. 24, 1984

[54] SOCKET CONTACT FOR ELECTRICAL CONNECTORS AND METHOD OF MANUFACTURE

[75] Inventors: Robert W. Brush, Sr., Unadilla; R. Amelia Piscitelli, Sidney, both of N.Y.

[73] Assignee: Bendix Corporation, Southfield, Mich.

[21] Appl. No.: 419,669

[22] Filed: Sep. 20, 1982

[51] Int. Cl.[3] ..... H01R 13/12

[52] U.S. Cl. ..... 339/258 R

[58] Field of Search ..... 339/258 R, 276 T

[56] References Cited

U.S. PATENT DOCUMENTS

| | | | |
|---|---|---|---|
| 3,564,487 | 2/1971 | Upstone et al. | 339/276 T |
| 4,120,556 | 10/1978 | Waldron et al. | 339/276 T |
| 4,272,150 | 6/1981 | Fairbairn | 339/276 T |
| 4,373,773 | 2/1983 | Piscitelli et al. | 339/276 T |

FOREIGN PATENT DOCUMENTS

| | | | |
|---|---|---|---|
| 2498826 | 7/1982 | France | 339/276 T |

*Primary Examiner*—Joseph H. McGlynn

*Attorney, Agent, or Firm*—J. R. Benefiel; R. J. Eifler

[57] ABSTRACT

A socket contact (10) for electrical connectors and method of manufacture comprised of a contact liner (12), a front guide sleeve (14), and a rear sleeve (16) each of said guide sleeve (14) and rear sleeve (16) interfit over the contact liner (12) with a slight overlap (42) at the approximate midsection of the contact liner (12). The guide sleeve (14) is enabled to be interfit with both the contact liner (12) and the rear sleeve (16) by a crimp (44) formed adjacent the rear end (40) of the guide sleeve (14). A fillet weld (48) is applied at the shoulder (46) created by the guide sleeve (14) overlapping the rear sleeve (16) which weld reinforces the midsection of the socket contact (10).

1 Claim, 2 Drawing Figures

SOCKET CONTACT FOR ELECTRICAL CONNECTORS AND METHOD OF MANUFACTURE

This invention concerns socket contacts for electrical connectors of the type adapted to cooperate with an inserted pin contact to establish an electrical connection.

Socket contacts are commonly employed in electrical connectors in which one or more of such socket contacts are mounted in a plug which mates with a corresponding pattern of pin contacts in a mating connector component.

Such socket contacts commonly consist of a spring member formed with a series of spring fingers adapted to receive a pin contact inserted upon mating of the connector components, the pin contact deflecting the spring fingers radially outward to establish a good electrical connection and to generate a retention force. Such contacts also include a terminal electrically connected to the spring member, the terminal adapted to be connected to an electrical conductor, as by crimping. Many such socket contacts also include an outer guide sleeve which is received over the spring member and which serves to guide the mating pin at insertion and protect the spring fingers from excessive deflection by mating with the pin contact.

Such socket contacts have heretofore been constructed by machining the spring member and terminal from solid stock material and subsequently installing a guide sleeve over the spring fingers.

An alternative construction has been employed in which sheet metal formed components are assembled in manufacturing the socket contact, in order to reduce costs over the machined version, and in order to allow the spring member and terminal portion to be constructed of different materials and plated with appropriate platings for each of these components.

Such formed sheet metal socket contacts have typically employed a contact liner sleeve formed with the spring fingers, a rear sleeve mounted over the contact liner, the rear sleeve adapted to be crimped onto an electrical conductor. A surrounding guide sleeve is received over the spring finger portions of the contact liner.

Such socket contacts are constructed in extremely small sizes and have been found to be vulnerable to fracture by the inadvertent application of excessive bending moments since the midsection is inherently of relatively low strength in such designs.

DISCLOSURE OF THE INVENTION

The present invention seeks to provide a strengthened socket contact of the formed metal construction as described which may be manufactured at relatively low cost.

The present invention achieves the strengthening of the midsection of such formed metal socket contacts by extending the guide sleeve to overlap the front end of the rear sleeve. The rear sleeve is staked to the contact liner and a filet weld applied to a shoulder established by the endface of the guide sleeve and the periphery rear sleeve to thus establish substantial strengthening of the midsection of the contact.

The guide sleeve may be formed with a circumferential crimp adjacent its rear end which extends radially inward to contact the exterior of the contact liner and locate the endface of the guide sleeve radially outward from the rear sleeve to create the shoulder enabling fillet welding of the rear and guide sleeve together.

The resultant contact structure has the advantage of a considerable strengthening of the contact midsection, with only a relatively low cost welding manufacturing step required to achieve this advantage, and without requiring one or more additional components.

DETAILED DESCRIPTION OF THE DRAWINGS

DETAILED DESCRIPTION OF THE INVENTION

Figure 1:
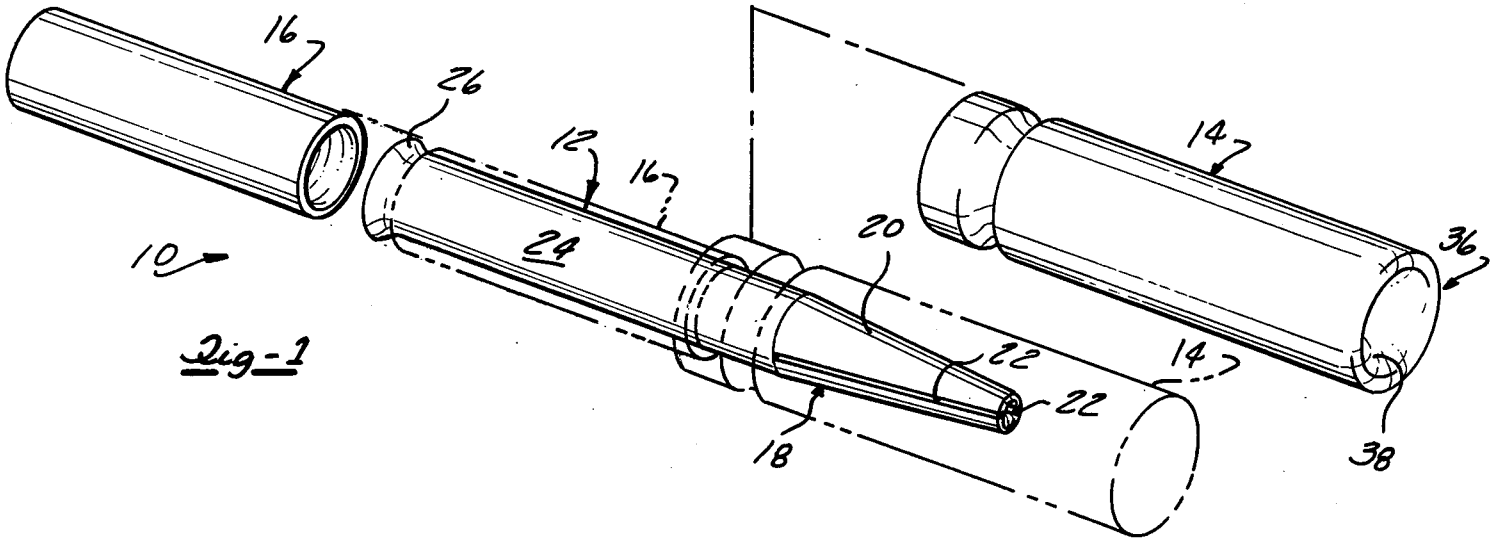
FIG. 1 is an exploded perspective view of the components according to the present invention, shown assembled in phantom.

Referring to FIG. 1, the socket contact 10 according to the present invention is constructed of these parts: a tubular contact liner 12, a front guide sleeve 14, and a rear sleeve 16.

The contact liner sleeve 12 is of generally tubular shape, and may be made by standard forming techniques as by forming from sheet metal. The contact liner 12 is constructed of a resilient conductive material such as beryllium copper, and a spring member section 18 at the front end thereof which spring member section 18 includes a pair of opposing spring fingers 20 created by an endwise slots 22 extending axially into the front end of the contact liner sleeve 12. The spring fingers 20 are convergent towards each other such that upon insertion of a pin contact of a mating connector (not shown) the spring fingers 20 will be deflected radially outwardly to create a contact pressure ensuring a good electrical connection and exerting a retention force.

The rear section 24 of the contact liner 12 is generally cylindrical and integral with the spring member secton 18, with its rear end flared at 26. The rear section 24 of the constant liner 12, receives the rear sleeve 16 thereover, to be coextensive therewith and is configured with a diameter to be slideably fit thereinto with the flared section 26 acting to retain the rear sleeve 16 thereon.

Figure 2:
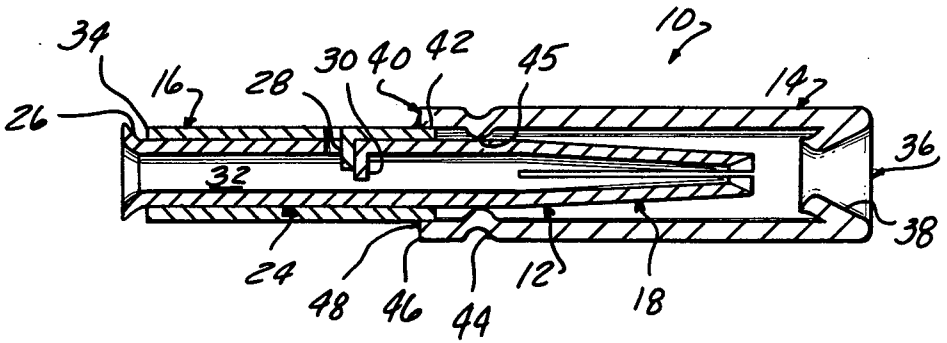
FIG. 2 is a longitudinal view of the socket contact shown in FIG. 1.

Referring to FIG. 2, the rear sleeve 16 is formed of conductive sheet metal and is staked together to the rear section 24 to form tabs 28 and 30 respectively protruding into the interior space 32 of the rear sleeve section 24 of the contact liner 12. This serves to axially locate the contact liner 12 and rear sleeve 16 axially in one direction and also serves to provide a wire stop.

The bare end of the conductor (not shown) is to be inserted into the interior space 32 and abut the lead tab 28 at the time the connection to the electrical conductor to the socket contact is made.

The guide sleeve 14 is formed at the front end 36 with an inwardly flared crimp 38 to guide the entrance of the contact pin of the mating connector (not shown). The rear end 40 of the guide sleeve is configured with an inside diameter corresponding to the outside diameter of the rear sleeve 16 such as to be slidably interfit with a slight degree of overlap at 42.

Adjacent the rear end 40 is a circumferential crimp 44 which extends radially inward to create an inside diameter 46 equal to the outside diameter of the rear section 24 of the contact liner 12, enabling the guide sleeve 14 to be interfit both with the contact liner 12 and the guide sleeve 14. The crimp 44 thus extends radially inward a distance sufficient to offset the thickness of the rear sleeve 16 to establish an annular surface of contact between the guide sleeve 14 and the rear sleeve section 24 of the contact liner 12, enabling the guide sleeve 14 to be interfit both with the contact liner 12 and the guide sleeve 14.

The overlap 42 thus establishes a shoulder 46 constituted by the endface of the rear guide sleeve 14 and the periphery of the rear sleeve 16.

According to the concept of the present invention this shoulder enables the formation of a fillet or other type weld 48 extending around the periphery of the guide sleeve and rear sleeve 16 such as to securely join these components together. The interlock created by the staked tabs 28 and 30 and the annular contact surface 46 with the outside diameter of the sleeve section 24 of the contact liner 12, a very effective reinforcement of the midsection of the socket contact 10 is achieved at a relatively low cost, by easily implemented manufacturing steps without necessitating the addition of reinforcing sleeves or the like.

The invention may of course employ various alternate specific configurations of these components.

Having described the invention what is claimed is:

1. A socket contact for an electrical connector comprising a tubular contact liner having a plurality of spring fingers at one end integral with and extending from a rear section thereof, a rear sleeve of a length to be coextensive with said rear section and of a diameter to be slidably received over said rear section, and a generally cylindrical front guide sleeve received over said spring fingers and having a rear end extending over a portion of said rear section, said rear end having an endface forming a shoulder with the periphery of said rear sleeve portion, said guide sleeve of a larger diameter than said contact liner, and said rear end formed with a circumferential crimp having an inside diameter substantially equal to the outside diameter of said sleeve section of said contact liner, said socket contact characterized by a fillet weld at the shoulder formed by the end face of said front guide sleeve and the periphery of said portion of said rear sleeve and also characterized in that said rear sleeve is staked to said sleeve section of said contact liner.

* * * * *